US005529823A

United States Patent [19]

Aumann

[11] Patent Number: 5,529,823

[45] Date of Patent: Jun. 25, 1996

[54] WATERPROOF CONNECTION DEVICES FOR GARMENTS

[76] Inventor: Johann Aumann, Bergham 2, 83052 Bruckmühl, Germany

[21] Appl. No.: 318,592

[22] Filed: Oct. 5, 1994

[30] Foreign Application Priority Data

Oct. 5, 1993 [DE] Germany ..... 9315096 U

[51] Int. Cl.[6] ..... B32B 9/00

[52] U.S. Cl. ..... 428/53; 428/48; 428/57; 428/77; 428/81; 428/411.1; 428/911; 428/245; 428/246; 2/69; 2/81; 2/85; 2/93; 2/97; 2/108; 2/236; 2/250; 2/272; 2/338

[58] Field of Search ..... 428/411.11, 414, 428/911, 48, 53, 57, 77, 81; 2/68, 81, 85, 93, 97, 108, 236, 250, 272, 338

[56] References Cited

U.S. PATENT DOCUMENTS

| | | | |
|---|---|---|---|
| 3,953,566 | 4/1976 | Gore | 264/505 |
| 4,187,390 | 2/1980 | Gore | 128/205.12 |
| 4,194,041 | 3/1980 | Gore et al. | 428/252 |
| 4,493,870 | 1/1985 | Vrouenraets et al. | 428/245 |
| 4,507,806 | 4/1985 | Coombs | 2/85 |
| 4,725,481 | 2/1988 | Ostapchenko | 428/213 |
| 4,748,691 | 6/1988 | Grilliot et al. | 2/81 |
| 5,158,719 | 11/1992 | Aumann | 2/87 |

FOREIGN PATENT DOCUMENTS

| | | |
|---|---|---|
| 7081491 | 10/1992 | Australia . |
| 0405062 | 3/1990 | European Pat. Off. . |
| 1355719 | 2/1964 | France . |
| 8910022 | 11/1989 | Germany . |

*Primary Examiner*—Patrick J. Ryan
*Assistant Examiner*—Abraham Bahta

[57] ABSTRACT

A waterproof connection device is provided for use with a garment having optionally many detachable liners including a functional layer insert having a water vapor permeable functional layer.

17 Claims, 4 Drawing Sheets

WATERPROOF CONNECTION DEVICES FOR GARMENTS

FIELD OF THE INVENTION

The invention relates to a waterproof connection device useful with a garment that has optionally many detachable layers including a thermal liner and a functional layer insert having a waterproof, water vapor permeable functional layer.

BACKGROUND OF THE INVENTION

For garments which are intrinsically water permeable, and as such are also water vapor permeable and wind permeable, it has proven useful to include a functional layer insert with a waterproof, water vapor permeable functional layer. This functional layer insert with functional layer prevents water such as rain and snow from penetrating the interior of garment. The functional layer also allows perspiration moisture to be transported to the outside. The wear comfort of such a garment is considerably increased by the fact that such a functional layer insert is usually windproof. Functional layers are often made from microporous polytetrafluoroethylene (PTFE).

Garments with functional layer inserts have proven particularly valuable in workwear such as in the armed forces, police, fire fighting and general workwear applications.

Presently, such garments are provided with a functional layer insert that is integrated during the construction of the garment so they cannot be separated from the rest of the garment. This may not be desirable, especially when the garment needs to be worn without the functional layer insert, particularly in good weather or if the garment must be rigorously cleaned after wearing in very dirty conditions such as for example, firefighting or other activities. After wearing, the garment must be submitted to rigid laundry procedures during which the functional layer could be damaged. Functional layer inserts are presently available that can be inserted into the garment by means of zippers, but these do not protect against the ingress of water.

There is a need for a connection assembly that allows at least one inner liner or insert to be provided to the inside of a garment which prevents water and other undesirable elements from entering the garment.

SUMMARY OF THE INVENTION

A waterproof connection device is provided for subsequently equipping the inside of a water permeable garment with at least one liner. Preferably, the liner is a functional layer insert equipped with a waterproof, water vapor permeable functional layer. The device that connects these liners and/or functional layer insert to the outer jacket consists of a functional layer strip with a first longitudinal side which can be connected to a longitudinal side edge of the functional layer insert and with an opposite second longitudinal side which is provided with a functional layer cover flap; an outer connection strip with a first longitudinal side edge which is attached on the outside of the functional layer strip between the two longitudinal sides thereof and an opposite second longitudinal side edge which can be connected to the garment; and an inner connection strip with a first longitudinal side edge which is provided to the functional layer strip in the area of the functional layer cover flap and an opposite second longitudinal side edge which can be connected with a closure device of a functional layer insert to be arranged on the inside of the functional layer strip and below the functional layer cover flap for closing and opening the functional layer insert.

The term "subsequent fitting" used herein denotes the first time a previously constructed garment which contained no waterproof or functional layer insert is subsequently equipped with a functional layer insert or the action of reinserting the insert which had been temporarily removed from the garment back into the garment.

DETAILED DESCRIPTION OF THE INVENTION

Figure 1:
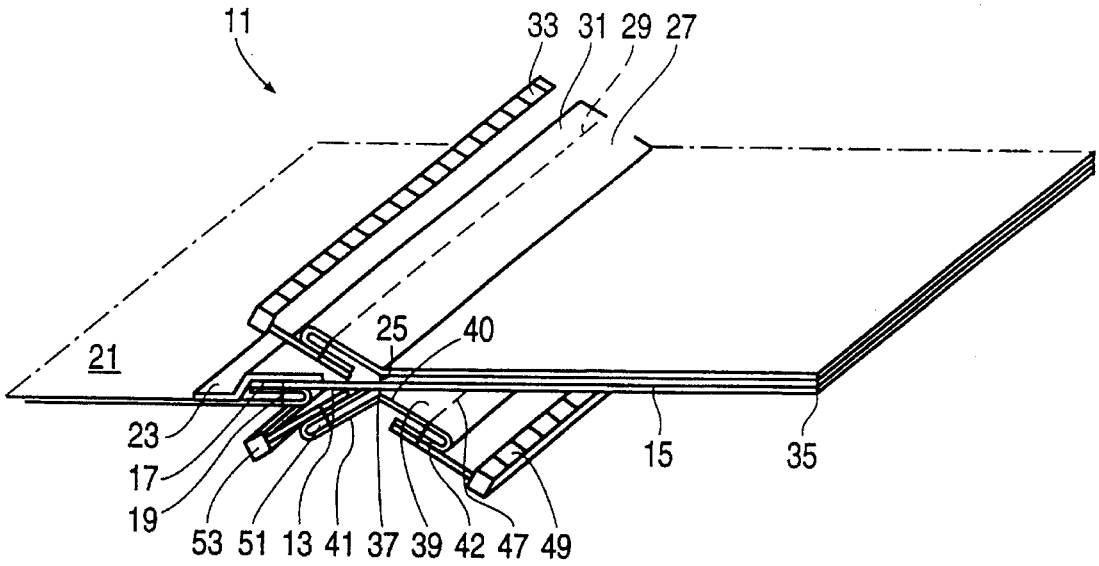
FIG. 1 is a perspective view of a connection device for detachably connecting a jacket, a functional layer insert and a second liner with preassembled zipper sides.

The invention relates to a waterproof connection device for use in a subsequent fitting of at least one inside liner to a garment. Preferably, the inside liner has a waterproof, water vapor permeable functional layer and is referred herein as a functional layer insert. The connection device is comprised of a functional layer strip with a first longitudinal side that is connected to a longitudinal edge of the functional layer insert and an opposite second longitudinal side of the strip having also a functional layer cover flap. An outer connection strip is also provided having a first longitudinal edge which is attached on the outside of the functional layer strip between two longitudinal sides and by an opposite second longitudinal side edge that can be connected to the garment. An inner connection strip is also provided having a first longitudinal edge which is provided to the functional layer strip in the area of the functional layer cover flap and with an opposite second longitudinal edge which can be connected to a closure device of a functional layer insert which is located on the inside of the functional layer strip and below the functional layer cover flap for closing and opening the functional layer insert.

A garment can be subsequently equipped with a functional layer insert by means of two such connection devices which are identical and mirror images of each other. This is either effected by means of a detachable closure device between the connection device and the garment if the liner and/or insert is to be detachably connected to the garment or by sewing if it does not need to be removed.

The connection device of the invention is not only advantageous if the garment was originally provided with a detachable waterproof liner such as a functional layer insert, but it is also suitable for subsequently equipping a garment which originally did not have any liners with them and which then may be connected to the garment by means of the connection device. The connection device is also suitable for use in a garment where the outermost layer is a vest and subsequent inner liners are waterproof inserts and thermal liners having vests as well as sleeves.

In a further embodiment, different connection options are provided for the detachable connection of the liner and/or insert. In these situations, the garment and the connection device may be worn either with the functional layer insert and without a second liner such as a thermal liner, or with only a second liner and not the functional layer insert, or in combination with both the functional layer insert and a second liner, depending on the weather.

In case of a jacket, both the functional layer insert and the second liner are also in the shape of a jacket, in a cut and size which matches the jacket with which they are to be combined. In the case of a vest, the functional layer insert and/or second liner is in the shape of the vest but the insert and liner may also be equipped with sleeves.

The connection device of the invention is preferably prefabricated as a separate component. The devices are preferably constructed at the site of manufacture of the functional layer who has the necessary technology and equipment for the production of a connection device to ensure its waterproofness and also has the capability of maintaining the waterproofness of the garment equipped with such connection devices and functional layer inserts. The prefabricated connection device may then be supplied to the garment manufacturer who then incorporates the devices into the finished garments.

The various attachments of the connection device among the garment, the functional layer insert and, if provided, the second liner is preferably accomplished with the use of several zippers. Velcro bands or snap button closures may also be used. These various closure options may also be combined with each other.

It is possible to have such closure devices, such as the zipper components already mounted during the construction of the connection device. In this case, the garment manufacturer simply needs to attach the complementary parts of such connection devices to the garment, the functional layer insert and, if provided, the second liner.

The invention is best understood with reference to the accompanying drawings.

Figure 1A:
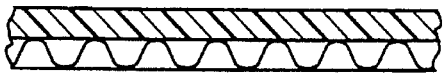
FIG. 1*a* is a cross-sectional view of the functional layer strip.

FIG. 1 is a schematic view of a first embodiment of a waterproof connection device of the invention. It comprises a functional layer strip 13 provided with a waterproof, water vapor permeable functional layer. The functional layer is preferably provided with a carrier textile to form a composite material on at least one side as shown in FIG. 1*a*. The functional layer strip 13 is provided with a functional layer cover flap 15 so that the strip and flap arc in one piece. The functional layer strip 13 is connected at one longitudinal side to a longitudinal edge 21 of an the functional layer insert so that it is waterproof, water vapor permeable and windproof, by a first sewn seam 19. The first sewn seam 19 is sealed with a waterproof seam sealing tape 23.

An outer connection strip 27 is connected to the upper outer part of the functional layer strip 13 by a first adhesive seam 25 that includes use of a waterproof adhesive material. A second sewn seam 29 attaches a side of a first zipper 33 at a first longitudinal side edge 31 of the outer connection strip 27. In the embodiment shown in FIG. 1, the outer connection strip 27 on the right side of the adhesive seam 25 covers the same area as that of the functional layer cover flap 15. The functional layer cover flap 15 and the outer connection strip 27 are connected to each other at their right ends by means of a second adhesive seam 35 made of a waterproof adhesive material.

A first longitudinal side edge 40 of an inner connection strip 39 and a lining connection strip 41 are attached in one piece at the inside of a part of the functional layer strip 13 by means of a third adhesive seam 37. The inner connection strip 39 and lining connection strip 41 are shown in the downward direction of FIG. 1. A side of a second zipper 49 is sewn to a second longitudinal side edge 42 of the inner connection strip 39 by means of a third sewn seam 47 and serves to open or close the insert. A side of a third zipper 53 is sewn to the lining connection strip 41 by means of a fourth sewn seam 51 for connecting a second liner to the outer garment.

In the embodiment shown in FIG. 1, the functional layer strip 13 and the functional layer cover flap 15, are required to be equipped with a waterproof, water vapor functional layer. The outer connection strip 27, the inner connection strip 39 and the lining connection strip 41 are each preferably equipped with a waterproof, water vapor permeable functional layer but the use of such a functional layer is optional.

Materials suitable for the functional layer comprise microporous expanded polytetrafluoroethylene (PTFE), as described in U.S. Pat. Nos. 3,953,566, 4,187,390; expanded PTFE, provided with hydrophilic impregnating agents and/or layers, as described in U.S. Pat. No. 4,194,041; breathable polyurethane layers; or elastomers such as copolyetheresters and their laminates, as described in U.S. Pat. Nos. 4,725,481 and 4,493,870.

In the embodiment shown in FIG. 1, the sewn seams 19, 29, 47 and 51 are in the form of turned in seams.

Figure 2:
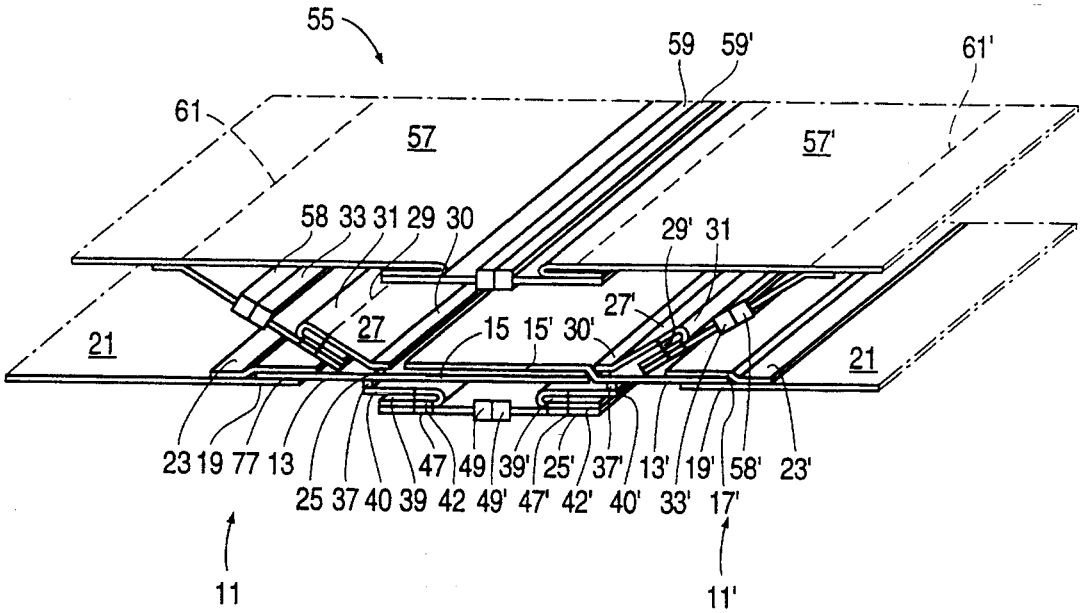
FIG. 2 shows a schematic sectional view of the front closure area of a jacket with two connection devices for connecting a functional layer insert.

FIG. 2 is a schematic partial view of a front closure area of a garment with two connection devices according to the invention, 11 and 11'. The two connection devices 11 and 11" are identical. They are only oriented in a different way so that they are mirror images of each other. The individual parts of the connection device are marked with the reference numbers and are differentiated between the right and left side by an apostrophe "'".

In the embodiment shown in FIG. 2, the jacket is equipped with a functional layer insert having a waterproof functional layer. The insert is provided with its left and right longitudinal edges 21 and 21' shown. A second thermal liner is not provided for in this embodiment.

The two connection devices 11 and 11' are similar to that shown in FIG. 1. Contrary to the embodiment in FIG. 1, there is no lining connection strip provided as the connection of a lining is not intended and the outer connection strip 27, 27' does not extend over the functional layer cover flap 15/15' but extends only to the first adhesive seam 25/25' where it is attached with a second longitudinal edge 30 of an outer connection strip.

The jacket 55 is provided with a left closure edge 57 and a right closure edge 57'. A fourth zipper 59 is attached to each of the two closure edges 57/57' and serves to close the jacket 55. Furthermore a fifth zipper (with two sicles) 58/58' is attached to each closure edge 57, 57' and interacts with a first zipper 33/33' to connect the connection device 11/11' to the closure edge 57/57'. This attachment is effected by a fifth sewn seam 61/61'.

The material of the jacket 55 is water permeable. Water which penetrates the jacket 55 and/or its zipper 59,59' can also penetrate the zippers 33, 58 and 33' and second sewn seams 29 and 29'. Further water penetration is prevented by the functional layer insert with the longitudinal side edges 21, 21', the functional layer strips 13, 13', and the superimposed functional layer strip cover flaps 15, 15'. The adhesive seams 25, 25' and 37, 37' prevent the further creeping of water in parallel to the functional layer strips 13, 13' and the functional layer cover flaps 15, 15'. The zipper 49, 49', which serves to close the functional layer insert, is protected against the ingress of water by the functional layer cover flaps 15, 15'.

Figure 3:
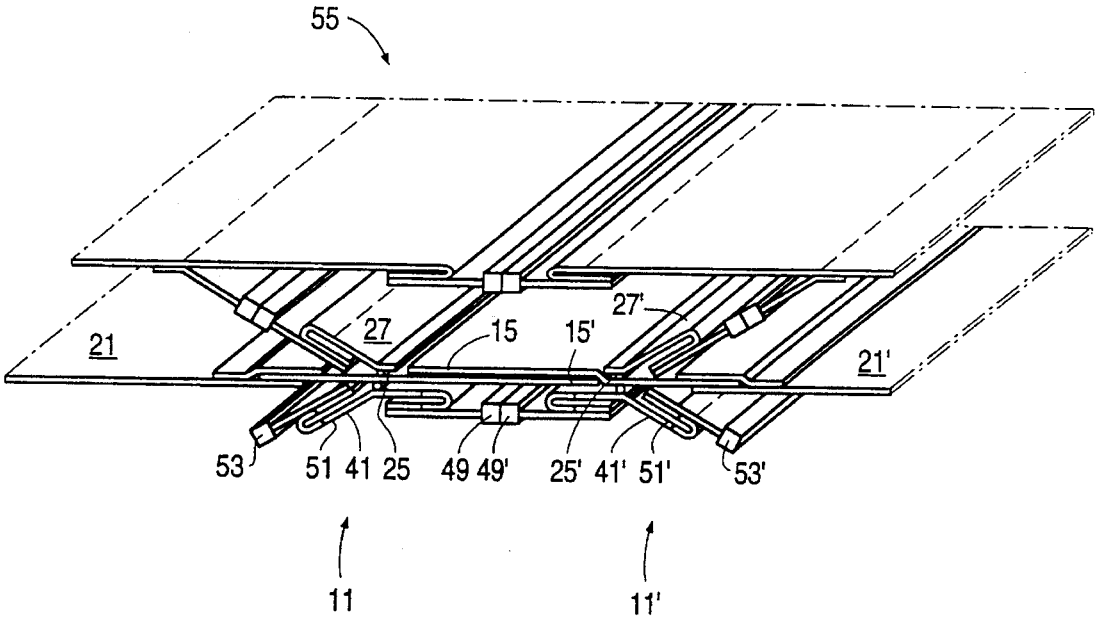
FIG. 3 shows a schematic sectional view of the front closure area of a jacket with two connection devices for connecting both a functional layer insert and a second liner.

FIG. 3 shows an embodiment with two connection devices 11 and 11' which are substantially identical to the connection device 11 shown in FIG. 1. Here, the outer connection strips 27, 27' do not extend over the functional layer cover flaps 15, 15' but end at the first adhesive seam 25, 25'. In FIG. 3, the two connection devices 11, 11' are connected to the jacket 55 similar to that shown in the embodiment of FIG. 2, however, lining connection strips 41, 41' similar to the connection device 11 shown in FIG. 1 are also provided. All other features of FIG. 3 are identical to those of FIG. 2.

Figure 4:
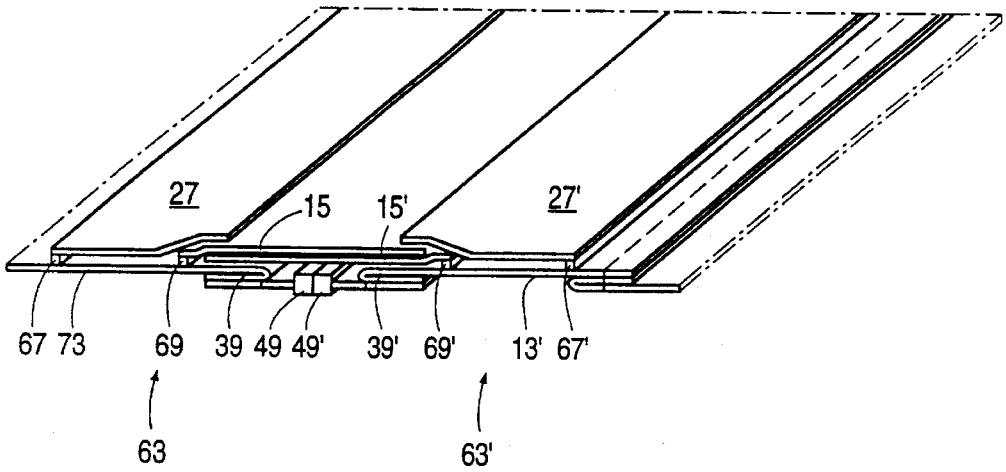
FIG. 4 shows a schematic sectional view of two connection devices of a different embodiment for connecting a jacket garment with a functional layer insert.

FIG. 4 shows an embodiment with two connection devices 63 and 63' which differ in design from the embodiments shown in FIGS. 1 to 3 in that both of the fourth adhesive seams 67, 67' and fifth adhesive seams 69, 69' are provided as substitutes for the first adhesive seams 25, 25' and third adhesive seams 37, 37' on the outside of each corresponding functional layer strips 13/13'. Outer connection strips 27, 27' are attached to the functional layer strip 13, 13' by means of the fourth adhesive seams 67, 67'. The functional layer cover flaps 15, 15' are attached to the functional layer strip 13 by means of the fifth adhesive seams 69, 69'. In this embodiment the inner connection strips 39, 39' are not attached to the functional layer strip 13, 13' but form one piece with the functional layer strip 13, 13'.

In the embodiment shown in FIG. 4, the outer connection strips 27, 27' do not yet include any connection devices (i.e. zippers) for connection to a jacket. If the connection devices 63, 63' of FIG. 4 only serve to subsequently equip a garment with a functional layer insert to be firmly connected, no closure devices such as zippers need be provided at the free ends of the outer connection strips 27, 27' as these free ends can be directly sewn to the jacket.

Figure 5:
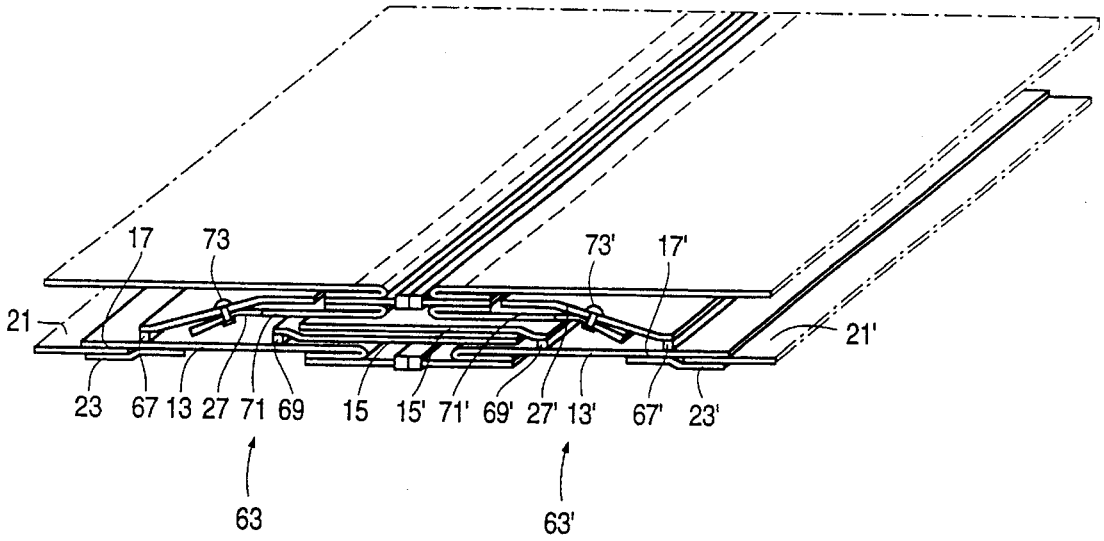
FIG. 5 shows a schematic sectional view of the front closure area of a jacket with two connection devices of the type shown in FIG. 4.

FIG. 5 is a schematic sectional view of the closure area of a garment with two connection devices 63, 63' of the type shown in FIG. 4. Jacket connection strips 71/71' are attached to the outer connection strips 27, 27' by means of snap buttons 73/73'. Since the functional layer strips 13, 13' are located under the snap buttons 73, 73' and since the adhesive seams 67, 67' and 69, 69' extend at both sides of the snap buttons 73, 73', the snap buttons 73, 73' do not need to be waterproof.

Figure 6:
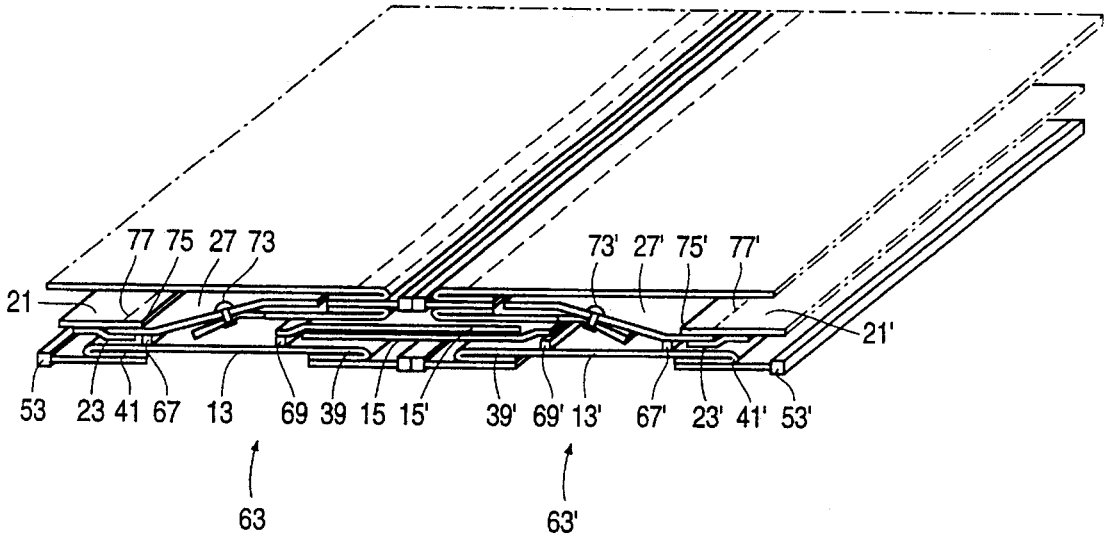
FIG. 6 shows a schematic sectional view of the front closure area of a jacket with two connection devices of the type shown in FIG. 4, which allow for connection of both a functional layer insert and a second liner.

FIG. 6 shows an embodiment of a garment with two connection devices 63, 63' of the type shown in FIG. 4 wherein an additional lining connection strip 41/41' is sewn to the zipper sides 53, 53' for connection of a second liner. The lining connection strips 41, 41', similar to the inner connection strips 39, 39', form one piece with the functional layer strip 13, 13'. In this embodiment, the outer connection strips 27, 27' project over both sides of the fourth adhesive seams 67, 67'. At the projecting part 75, 75' of the corresponding outer connection strip 27, 27' not equipped with snap buttons 73, 73', a sixth sewn seam 77/77' is provided to attach one longitudinal side edge 21, 21' of the functional layer insert.

The seam sealing tapes 23, 23' of FIGS. 4, 5, and 6 are arranged on the insides of the outer connection strips 27, 27' directed downwards.

I claim:

1. A waterproof connection device for subsequently equipping the inside of a water permeable garment with a functional layer insert having a waterproof, water vapor permeable functional layer, comprising:

(a) a functional layer strip with a first longitudinal side connectable to a longitudinal side edge of the functional layer insert and an opposite second longitudinal side which is provided with a functional layer cover flap;

(b) an outer connection strip with a first longitudinal side edge which is attached on the outside of the functional layer strip between the two longitudinal sides and an opposite second longitudinal side edge which is connectable to the garment; and (c) an inner connection strip with a first longitudinal side edge which is provided to the functional layer strip in the area of the functional layer cover flap and an opposite second longitudinal side edge which is connectable with a closure device of a functional layer insert to be arranged on the inside of the functional layer strip and below the functional layer cover flap for closing and opening the functional layer insert.

2. A connection device of claim 1, wherein a lining connection strip is provided at the first longitudinal side of the functional layer strip and is connected to a lining connection device to be arranged on the inside of the functional layer strip for detachably connecting a liner to be worn within the functional layer insert.

3. A connection device of claim 1, wherein the outer connection strip, the inner connection strip, and a lining connection strip are equipped with a functional layer.

4. A connection device of claim 3, wherein the outer connection strip is attached to the outside of the functional layer strip by means of a first adhesive seam comprised of a waterproof adhesive material.

5. A connection device of claim 3, wherein the functional layer cover flap is one piece with the functional layer strip and the inner connection strip is attached to the inside of the functional layer strip by means of a second adhesive seam comprised of a waterproof adhesive material.

6. A connection device of claim 5, wherein the lining connection strip is one piece with the inner connection strip and the lining connection strip extends away from the second adhesive seam on the side of the second adhesive seam facing away from the functional layer cover flap.

7. A connection device of claim 3, wherein the inner connection strip forms one piece with the functional layer strip and the functional layer cover flap is attached to the outside of the functional layer strip by means of a second adhesive seam comprised of a waterproof adhesive material.

8. A connection device of claim 7, wherein the outer connection strip projects at both sides over the first adhesive seam and wherein the longitudinal side edge of the outer connection strip facing the functional layer cover flap is connectable to the garment and the longitudinal side edge of the outer connection strip facing away from the functional layer cover flap is connectable to the longitudinal side edge of the functional layer insert.

9. A connection device of claim 8, wherein the lining connection strip is one piece with the functional layer strip.

10. A connection device of claim 1, wherein a zipper for a detachable garment connection is attached to the second longitudinal edge of the outer connection strip.

11. A connection device of claim 1, wherein a snap button is attached to the second outer connection strip for a detachable garment connection.

12. A connection device of claim 1, wherein a zipper is attached to the second longitudinal side edge of the inner connection strip for a detachable connection of a functional layer insert.

13. A connection of claim 2, wherein a zipper is attached to the lining connection strip for a detachable connection of a liner.

14. A garment made from a water permeable material and a functional layer insert, said garment having an openable front closure device in the form of a zipper, and at least one waterproof connection device, wherein each connection device comprises:

(a) a functional layer strip with a first longitudinal side which is connected to a longitudinal side edge of the functional layer insert and an opposite second longitudinal side provided with a functional layer cover flap;

(b) an outer connection strip with a first longitudinal side edge which is attached on the outside of the functional layer strip between the two longitudinal sides and an opposite second longitudinal side edge which is connectable to the garment; and (c) an inner connection strip with a first longitudinal side edge which is provided to the functional layer strip in the area of the functional layer cover flap and an opposite second longitudinal side edge which is connectable with a closure device of the functional layer insert to be arranged on the inside of the functional layer strip and below the functional layer cover flap for closing and opening the functional layer insert.

15. A garment of claim 14, wherein the connection device is connected to the garment by means of a zipper.

16. A connection device of claim 14, wherein both connection devices are mirror images of each other.

17. A vest having a water permeable outer shell and a functional layer insert, said vest further provided with an openable front closure device in the form of a zipper, and at least one waterproof connection device, wherein each connection device further comprises:

(a) a functional layer strip with a first longitudinal side which is connected to a longitudinal side edge of the functional layer insert and an opposite second longitudinal side provided with a functional layer cover flap;

(b) an outer connection strip with a first longitudinal side edge which is attached on the outside of the functional layer strip between the two longitudinal sides and an opposite second longitudinal side edge which is connectable to the garment; and (c) an inner connection strip with a first longitudinal side edge which is provided to the functional layer strip in the area of the functional layer cover flap and an opposite second longitudinal side edge which is connectable with a closure device of the functional layer insert that is arranged on the inside of the functional layer strip and below the functional layer cover flap for closing and opening the functional layer insert.

* * * * *